US006960126B2

(12) United States Patent
Desai

(10) Patent No.: US 6,960,126 B2
(45) Date of Patent: Nov. 1, 2005

(54) WIRELESS COMMUNICATION FOR FUME HOOD CONTROL

(75) Inventor: Mehul Desai, Weymouth, MA (US)

(73) Assignee: Honeywell International Inc., Morristown, NJ (US)

( * ) Notice: Subject to any disclaimer, the term of this patent is extended or adjusted under 35 U.S.C. 154(b) by 235 days.

(21) Appl. No.: 10/268,266

(22) Filed: Oct. 10, 2002

(65) Prior Publication Data

US 2004/0072529 A1 Apr. 15, 2004

(51) Int. Cl.[7] ..... B08B 15/02
(52) U.S. Cl. ..... 454/61
(58) Field of Search ..... 454/56, 61

(56) References Cited

U.S. PATENT DOCUMENTS

| | | | | |
|---|---|---|---|---|
| 4,528,898 A | | 7/1985 | Sharp et al. | |
| 4,706,553 A | | 11/1987 | Sharp et al. | |
| 4,893,551 A | | 1/1990 | Sharp et al. | |
| 5,117,746 A | | 6/1992 | Sharp | |
| 5,215,497 A | * | 6/1993 | Drees | 454/61 |
| 5,240,455 A | | 8/1993 | Sharp | |
| 5,385,505 A | * | 1/1995 | Sharp et al. | 454/238 |
| 5,439,414 A | | 8/1995 | Jacob | |
| 5,562,537 A | | 10/1996 | Zver et al. | |
| 5,733,188 A | * | 3/1998 | Jacob | 454/56 |
| 6,137,403 A | | 10/2000 | Desrochers et al. | |
| 6,252,689 B1 | | 6/2001 | Sharp | |

FOREIGN PATENT DOCUMENTS

| | | | | |
|---|---|---|---|---|
| AU | B-63730/90 | * | 12/1991 | 454/61 |
| DE | 100 28 333 A1 | | 12/2001 | |
| WO | WO 91/13700 | * | 9/1991 | 454/61 |

* cited by examiner

*Primary Examiner*—Harold Joyce

(57) ABSTRACT

A method and apparatus for controlling a fume hood. A containment condition, i.e., a condition that may affect containment of potentially harmful substances in the hood, may be detected, and information regarding the detected condition sent by wireless signal. A fume hood controller may control at least airflow in the hood base on the information contained in the wireless signal.

37 Claims, 4 Drawing Sheets

WIRELESS COMMUNICATION FOR FUME HOOD CONTROL

BACKGROUND OF INVENTION

1. Field of Invention

This invention relates to wireless communication for control of fume hoods.

2. Discussion of Related Art

Fume hoods are commonly used in school and industry settings for handling potentially harmful materials, particularly substances that give off noxious fumes. A typical fume hood includes a housing within which the harmful materials may be stored and used. Users may access the interior of the housing through an opening, which in some hoods may be opened and closed by one or more movable sashes. The housing is vented so that air and potentially harmful gases or other materials in the housing are exhausted through ductwork. Fresh air is drawn in through the hood opening to help keep potentially harmful materials contained, i.e., prevent harmful materials from exiting the hood through the opening into the space where people may be located.

Proper control of airflow through the hood opening may be important for safety, economic, comfort or other reasons. For example, if airflow through the hood opening is too low (e.g., the velocity of airflowing through the opening or face velocity is too low), contaminants inside the hood may have an opportunity to exit the hood through the opening. However, maintaining a high volume airflow through the hood opening at all times may be wasteful because unnecessarily large volumes of conditioned air (e.g., cooled or heated air) in the room may be drawn into the hood and exhausted from the building. As a result, additional air must be conditioned and supplied to the room to replace the exhausted air. Some hood control systems lower the airflow or face velocity of air at the hood opening in certain conditions, such as when the hood opening is closed or nearly closed or when the hood is not being used. Airflow is then increased when the opening is enlarged and/or if the hood is in use. Such control systems are well known and are described, for example, in U.S. Pat. Nos. 4,706,553; 4,893,55 1; 5,117,746; 4,528,898 and others. These patents describe various systems for detecting a hood opening size, such as by detecting sash position, and using the hood opening size to control flow through the hood. For example, some of these systems use one or more sensors to detect the position of one or more sashes and send this information by a wired connection to a fume hood control which then uses the information to control airflow in the hood.

SUMMARY OF INVENTION

The inventor(s) has(have) discovered that providing a wireless signal to a fume hood controller that includes information regarding the hood opening size or other containment condition and/or controlling a damper/blower via wireless signal can provide benefits, such as reducing the number of wires in a fume hood that may be damaged by corrosive materials in the fume hood or damaged by moving sashes or other parts. Sending such information wirelessly also can allow a fume hood controller to receive containment information from a variety of areas of the opening (e.g., the position of different sashes used to adjust the size of the hood opening), or even containment information from several hoods in the same room or building. Such an arrangement can also allow rapid and simplified exchange of sensor, damper or other equipment. That is, different types of components may be combined together in a modular fashion since no physical connection need be made and the components may communicate wirelessly. For example, the fume hood controller can communicate wirelessly with a blower or damper used to control airflow through the hood or other components in a fume hood system. Such an arrangement can allow a single controller to control the operation of several fume hoods by wirelessly receiving information from one or more sensors from one or more hoods, and wirelessly controlling the blower or damper for all of the hoods. As a result, the different fume hoods may include different types and numbers of sensors, different types of airflow control devices (blowers, dampers, etc.) and other components, yet still be controlled by the same controller. The reduced number (or elimination) of wired connections can also make for easier installation and/or addition of hoods to an existing arrangement.

In one aspect of the invention, a fume hood apparatus includes a fume hood housing having a hood opening, and at least one sensor that detects a containment condition, i.e., a condition related to containment of potentially harmful substances in the hood. A transmitter transmits a wireless signal including information representing the detected containment condition, and a fume hood controller receives the wireless signal and controls at least airflow through the hood opening based on the information representing the detected containment condition.

In one aspect of the invention, a fume hood apparatus includes at least one sash movable to adjust a fume hood opening. At least one sensor detects a position of the sash, and a transmitter transmits a wireless signal including information representing a detected position of the sash. A fume hood controller receives the wireless signal and controls at least airflow through the fume hood opening based on the information representing the detected position of the sash.

In one aspect of the invention, a method for controlling a fume hood apparatus includes providing a fume hood housing having a hood opening, and detecting a containment condition of the hood. A wireless signal is transmitted including information representing the detected containment condition, and at least airflow through the hood opening is controlled based on the wireless signal.

In one aspect of the invention, a fume hood apparatus includes at least one sensor that detects a containment condition related to containment of substances in a fume hood housing having a hood opening, and an airflow control device that controls airflow through the hood opening. A fume hood controller receives information from the sensor regarding the detected containment condition and sends a wireless signal to the airflow control device to control at least airflow through the hood opening based on the information representing the detected containment condition.

In one aspect of the invention, a fume hood controller and/or other components of a fume hood system may take action to maintain containment in a case where wireless signals are not properly received. For example, if the controller does not properly receive one or more wireless signals containing information regarding a detected containment condition, the controller may control an airflow control device (such as a damper) in the fume hood to provide a maximum airflow, automatically reduce the size of the hood opening, instruct a transmitter to retransmit a signal, sound an alarm and/or take other action to help maintain containment in the hood. Similarly, if an airflow control device does not properly receive control information by wireless signal from the controller, the airflow control device may provide for maximum airflow, request the controller to retransmit a wireless signal, etc. These safety features may help prevent release of potentially harmful substances from the hood in cases where wireless communication between components in the fume hood system are interrupted.

BRIEF DESCRIPTION OF DRAWINGS

The accompanying drawings, are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
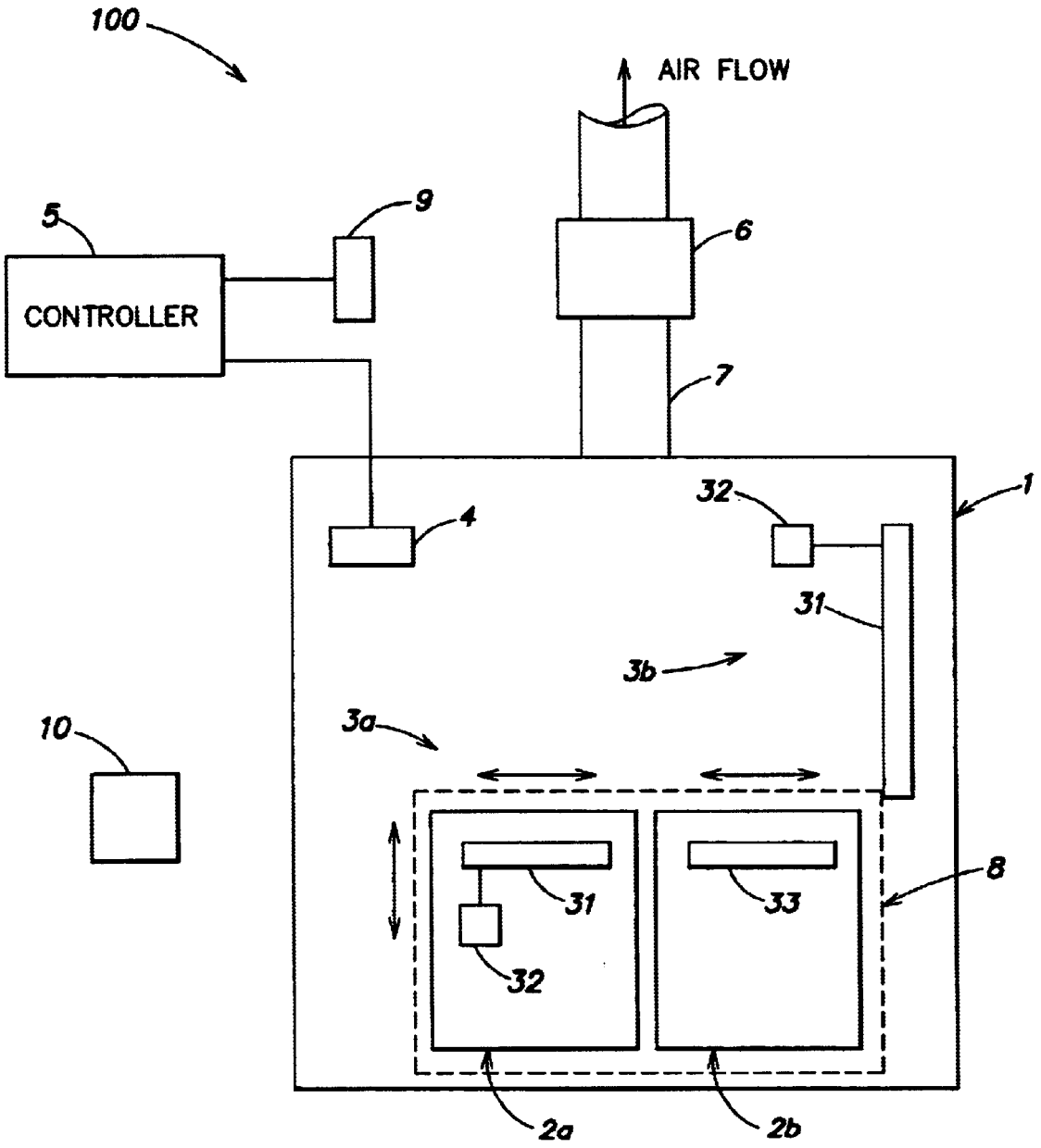
FIG. 1 is schematic block diagram of a fume hood apparatus in accordance with the invention.

Various aspects of the invention are described below with reference to illustrative embodiments. However, it should be understood that the invention is not limited to those embodiments described below, but instead may be used in any suitable system or arrangement. For example, aspects of the invention are described below in connection with a fume hood having movable sashes to adjust a hood opening. However, aspects of the invention may be used with other fume hood types, such as those having a fixed hood opening and a sensor that detects a change at the hood opening, such as the presence of a person using the hood, the movement of air or other objects at the hood opening, etc.

As discussed above, in one aspect of the invention, a wireless signal including information regarding a containment condition at the fume hood opening is sent to a fume hood controller so that at least airflow through the hood may be controlled based on the information. Sending such information by wireless signal may eliminate a physical connection between the fume hood controller and one or more sensors used to monitor conditions at the hood opening. Elimination of such a physical connection may allow for more reliable operation since wires and other hardware needed to make the connection may not be present to break or otherwise fail in the potentially highly corrosive environment inside the fume hood. Eliminating the physical connection may also allow for more flexibility in system design since various different sensors may be used with a same controller type. For example, a controller may be designed to operate using information from one or more sensors. One application may require a single reel-type cable sensor for detecting sash height. Another system may require a reel-type sensor as well as a reed switch/resistor string sensor used to detect horizontal movement of the sash. Other applications may require three or more sensors. In all of these cases, the same controller having a single receiver may be used with any suitable number of sensors; the only difference may be that the controller is configured to receive wireless information from different numbers of sensors. The controller may have a single receiver because multiple connection points and/or other hardware for the multitude of wires that would be needed for a hardwired connection to all sensors is not required. It should be understood, however, that a system or method in accordance with the invention may include a hardwired connection (including fiber optic and other similar connections) between one or more sensors and the controller. For example, a system may have one sensor connected by wire to the controller, while one or more other sensors communicate wirelessly with the controller.

One or more sensors used to detect a containment condition at the hood opening may use any suitable device or combination of devices to detect the condition. For example, sash movement may be detected using a well known reel sensor having a rotary potentiometer and cable attached to a sash. The cable is wound around a spring-loaded reel and attached at one end to the sash. As the sash moves, the cable is pulled from, or wound onto, the reel, causing the reel to rotate. This rotation causes the potentiometer to turn and output a variable resistance that indicates the position of the reel, and thus position of the sash. This is only one type of sensor, and any other suitable sensor may be used to detect a containment condition. Other sensors for detecting sash movement include Hall effect switches, reed switches, search coils, radio frequency (RF) tags, photosensors or other optical detectors, as is known in art. For example, U.S. Pat. No. 6,137,403, hereby incorporated by reference in its entirety, describes several systems for detecting sash position. Another type of sensor is a machine vision system that analyzes images of the movable sash or other element and determines the position of the sash and/or size of the hood opening based on the image analysis. Other types of sensors may be used to detect other types of containment conditions. U.S. Pat. No. 5,240,455, hereby incorporated by reference in its entirety, also describes several systems that detect the presence of a user at the hood opening, air motion at or near the hood opening, and other conditions that may affect the containment of potentially harmful material inside the hood. The sensor used to detect such conditions may include one or more airflow sensors, infrared detectors, thermal anemometers, photo-optical detectors, ultrasonic detectors, machine vision systems, position encoders or other mechanical position indicators, and so on. Any such systems may be used as a sensor to detect a condition change at the hood opening in accordance with the invention.

A containment condition detected by one or more sensors regarding the hood opening may be used by a wireless transmitter to send a wireless signal that contains at least information regarding the detected condition. For example, the wireless signal may include information regarding an actual position of a sash, a movement of the sash from a previous position, a speed of the sash, direction of movement of the sash, a size of the hood opening, an indication of whether the hood is being used, a presence of a person at or near the hood opening, airflow characteristics at the hood opening, movement of objects at the hood opening, the presence of particular, potentially harmful materials at or near the hood opening, or any other suitable information. The wireless signal may be sent using any suitable frequency, protocol, format or other arrangement. Further, the signal may include information to identify the sensor and/or transmitter sending the signal and/or to help prevent problems regarding cross talk, interference or other communication problems. In short, any suitable wireless communication system may be used to send the wireless signal.

A fume hood controller receiving the wireless signal may use information in the signal in any suitable way to control the system. For example, the fume hood controller may adjust airflow through the hood opening and/or the flow of air removed from the hood by adjusting a blower or damper associated with the hood. The controller may automatically adjust the size of the hood opening, e.g., automatically open or close one or more hood sashes. The controller also may provide an alarm in particular situations where hood containment may be less than optimal, may adjust airflow to achieve a desired face velocity or other condition, or perform any other suitable functions. The controller may also include safety features to ensure containment in the event that wireless communications are somehow interrupted or otherwise compromised. For example, if the controller does not receive a wireless signal from a particular sensor or group of sensors for a given amount of time, e.g., 0.5 sec, or if a received signal is unintelligible, the controller may take action to ensure that containment is properly maintained. In such situations, the controller may send a request for a retransmission of the signal and/or automatically adjust airflow in the hood to a maximum airflow, may automatically close one or more hood openings, sound an alarm, etc. The controller may also initiate a backup communication system, e.g., signal another wireless transmitter or sensor to begin detection of a containment condition and sending information regarding the detected condition.

In one aspect of the invention, the fume hood controller may control at least airflow through the hood by outputting a wireless signal to an airflow controller, such as a damper, blower, bypass valve, etc. That is, the controller may include a wireless transmitter that sends a signal to components of the fume hood to control at least airflow through the hood. The controller may send other control information wirelessly, such as information to user keypads or other input/output devices, information to a building environmental control, information to a system operator (e.g., a voice mail or text message to a phone, computer or other communication device of the operator), and so on. The transmitter used by the controller to send wireless information may be integral with the wireless receiver used to receive wireless information regarding the detected containment condition, or may be separate. Of course, the controller may control components of the fume hood by wireless signal, but receive information regarding containment conditions by wire connection. A controller may also be configured to wirelessly communicate with components of two or more fume hoods, and coordinate control of all of the hoods.

FIG. 1 shows an illustrative embodiment of a fume hood assembly 100 in accordance with the invention. Although FIG. 1 shows a single hood housing 1 under the control of a fume hood controller 5, it should be understood that any suitable number of hood housings 1 under the control of one or more controllers 5 may be used in accordance with the invention. In this embodiment, the housing 1 has a pair of sashes 2*a* and 2*b* that may be moved to adjust the size of the hood opening 8 (a maximum hood opening size is shown by the dashed lines in FIG. 1). The sashes 2 may be moved in any suitable way, but in this embodiment are movable in both horizontal and vertical directions to adjust the size of the hood opening 8. Horizontal movement of the sashes 2 is detected by a sash position indicator 3*a*, while vertical movement of the sashes 2 is indicated by a sash position indicator 3*b*. Horizontal sash position is detected by a sensor 31 in the horizontal sash position indicator 3*a*. Likewise, a sensor 31 in the vertical sash position indicator 3*b* detects vertical sash position. Any suitable sensor or combination of sensors may be used to detect sash position, such as magnetically-actuated reed switches, radio frequency (RF) tags, ultrasonic tags, Hall effect devices, sensor coils, machine vision systems, etc. As discussed above, although this illustrative embodiment includes sash position indicators that provide information regarding a containment condition, other embodiments of the invention may provide other types of containment information, such as the presence of a person at the hood opening 8, etc.

Depending upon the particular type of sensor 31, an emitter 33 may be required to interact with the sensor. For example, the emitter 33 may emit a magnetic field, electromagnetic radiation, or other signal that is detected by the sensor 31. In one illustrative embodiment, the emitter 33 may be one or more permanent magnets that causes magnetically-actuated reed switches in the sensor 31 to close, thereby indicating the relative position of the two sashes 2*a* and 2*b*. The emitter 33 may reflect radiation from the sensor 31, for example, in the case of an optical detector that emits light that is reflected by a mirror or other device acting as an emitter 33 so the sensor 31 may detect the reflected light. In another illustrative embodiment, the emitter 33 may be a transponder that transponds a radio frequency interrogation signal sent by the sensor 31. The transponder may receive the interrogation signal, modulate the signal or otherwise modify the signal to include information and send a return signal back to the sensor 31. The emitter 33 may include other features, such as a barcode or other indicia, or physical features that may be detected by the sensor 31.

In this embodiment, the horizontal sash position indicator 3*a* uses an emitter 33 on the sash 2*b* to work in conjunction with the sensor 31. However, the vertical sash position indicator 3*b* does not include an emitter 33. For example, the sensor 31 in the vertical position indicator 3*b* may be a cable reel and potentiometer sensor that indicates the vertical sash position without requiring an emitter 33.

The hood opening information detected by the sensors 31 is provided to transmitters 32 that use the information to generate a wireless signal. Although in this embodiment the position indicators 3*a* and 3*b* have independent transmitters, two or more sensors may share one transmitter. The transmitter 32 may include any suitable hardware and/or software for generating and sending any suitable wireless signal. For example, the transmitter 32 may be a wireless LAN access point, any suitable radio transmitter, an optical signal transmitter, ultrasonic transmitter, infrared transmitter, etc. The wireless signal may be sent in any suitable format using any suitable protocol, etc. For example, a wireless signal may be formatted in accordance with the 802.11 standard, or may use any custom formatting. Information contained in the signal may be encoded in any suitable way as is well known in the art. The wireless signal may include information that represents the identity of the transmitter 32 and or sensor 31 that provided information included in the signal so that a receiver of the wireless signal can determine which sash position indicator 3 sent the signal. Other potentially useful information may also be included, such as a time stamp, error correction code, and so on. For example, the wireless signal, transmitter and receiver may be arranged to avoid or otherwise handle communication collisions, interference from outside transmitters or other sources that may affect wireless communications.

The fume hood controller 5 may include any suitable receiver 4 for receiving the wireless signal from the sash position indicators 3 or other sensor/transmitter arrangements. Thus, the receiver 4 may be a wireless LAN access point, any other suitable radio receiver, optical receiver, ultrasonic receiver, etc. Further, it should be understood that the receiver 4 may be arranged to transmit wireless information as well as receive wireless signals. This may allow the fume hood controller 5 to conduct two way communications with the sash position indicators 3. (In this case, the transmitters 32 may be configured to receive wireless signals as well.) The receiver 4 may be positioned in any suitable location, such as on the interior of the hood housing 1, on the exterior of the housing 1, etc. Of course, in some embodiments, the placement of the receiver 4 may depend upon a position of the transmitter 32. For example, if the transmitter and receiver communicate by a line-of-sight type system, such as some infrared or other optical communication systems, the receiver 4 may be positioned so that it can appropriately receive a wireless signal from the transmitter 32. For example, in one embodiment, the transmitter 32 for the position indicators 3 may be positioned inside the housing 1, and the receiver 4 may be positioned inside the housing 1 as well to facilitate communications. Receipt of signals from multiple transmitters 32 may be handled in any suitable way by the transmitter, such as instructing transmitters to transmit wireless signals in unique timeslots, or having transmitters monitor for other wireless signals before transmission and only send a signal when other transmitters are not active.

Based on the wireless signal from the sash position indicator 3, the controller 5 may take any suitable action to control airflow through the hood or perform any other desired functions. For example, the controller 5 may receive a wireless signal that indicates the position of one or more sashes, calculate a size of the hood opening 8, and control a damper 6, a blower or other device to adjust the airflow through a conduit 7 connected to the housing 1, and thus control airflow through the hood opening 8. Of course, the transmitter 32 may calculate a hood opening and send the hood opening size in the wireless signal. Control of the damper 6 (or other airflow control device) may be performed by sending a wireless signal via a transmitter 9, or by wired connection, to the damper 6. Like the wireless communications regarding the detected containment condition, the wireless signal sent by the controller 5 may be in any suitable format, protocol, etc. Other desired functions may be performed by the controller 5, such as providing alarms for insufficient containment conditions, automatic movement of the sashes, e.g., automatic closing of the sashes if there is no person present in the room where the hood is located, communication with a building-wide environmental control system to indicate current needs for conditioned air in the hood environment, and so on. Signals sent for such control functions may also be sent by wireless communication. For example, the controller 5 may communicate wirelessly with a user input device/display 10 by which an operator can interact with the controller 5.

The controller 2 may include any suitable general purpose data processing system, which can be, or include a suitably programmed, general purpose computer or network of general purpose computers and other associated devices such as communication devices and/or other circuitry or components necessary to perform the desired input/output or other functions. The controller 2 can be implemented, at least in part, as single special purpose integrated circuits, e.g., ASICs or an array of ASICs, each having a main or central processor section for overall, system-level control and separate sections dedicated to performing various different specific computations, functions and other processes under the control of the central processor section. The controller 2 can also be implemented using a plurality of separate dedicated programmable integrated or other electronic circuits or devices, e.g., hard wired electronic or logic circuits, such as discrete element circuits or programmable logic devices. The controller 5 also can include other devices, such as information display devices (monitors, printers, display lights, etc.), user input devices (a keyboard, user pointing device, touch screen or other user interface), data storage devices, communication devices, airflow sensors, or other electronic circuitry or components.

Figure 2:
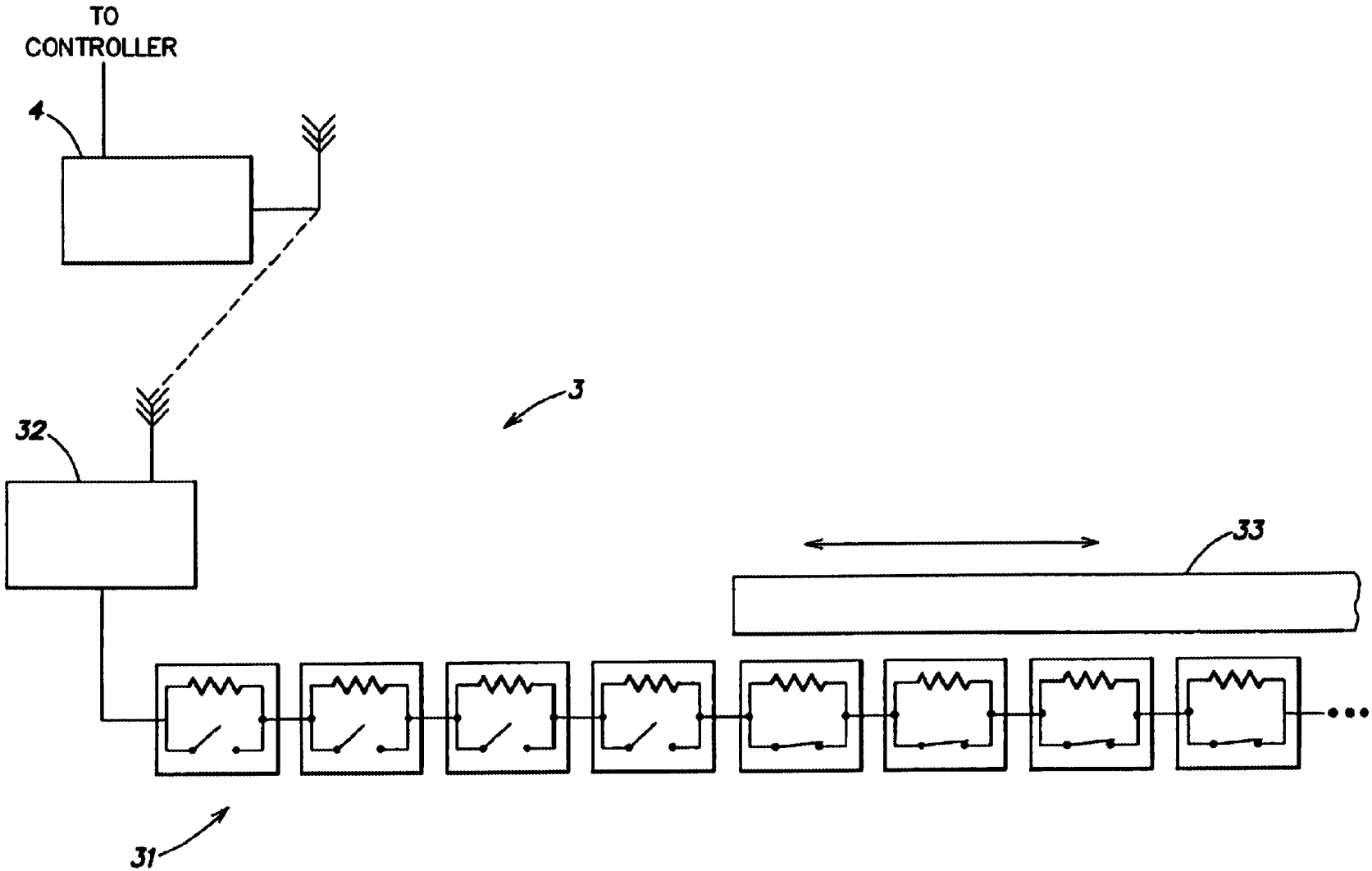
FIG. 2 is a schematic block diagram of a sash position indicator in accordance with the invention.

FIG. 2 shows a schematic diagram of an illustrative embodiment of a sash position indicator 3. In this illustrative embodiment, the position indicator 3 has a sensor 31 that includes a plurality of magnetically-actuated reed switches and a resistor string. The switches and resistors may be arranged in a linear array on a sash, such as the sash 2*a* shown in FIG. 1. An emitter 33, in this embodiment a bar magnet, may be arranged on another sash, such as the sash 2*b* in FIG. 1, or on a portion of the housing 1. It should be understood, of course, that the sensor 31 may be fixed in place on the housing 1 and the emitter 33 mounted to a movable sash. In this embodiment, as the sashes 2*a* and 2*b* move relative to each other, the emitter 33 causes those switches in the sensor 31 that are in close proximity to close. By closing, an associated resistor for the closed switch is bypassed. Thus, the resistor string may output a voltage and/or resistance that varies depending upon the relative positions of the movable sashes 2*a* and 2*b*. This variable voltage and/or resistance can be used to determine the size of the hood opening 8 that is open for air passage. Thus, the sensor 31 may provide information to the transmitter 32 that represents a condition of the hood opening 8, in this case the relative position of one or more sashes. The transmitter 32 may send a wireless signal to the receiver 4 that contains this and/or potentially other information. As discussed above, the sensor 31 and/or emitter 33 are not limited to the embodiment shown in FIG. 2. Other sensors and suitable emitters, if necessary, may be used in other embodiments.

Figure 3:
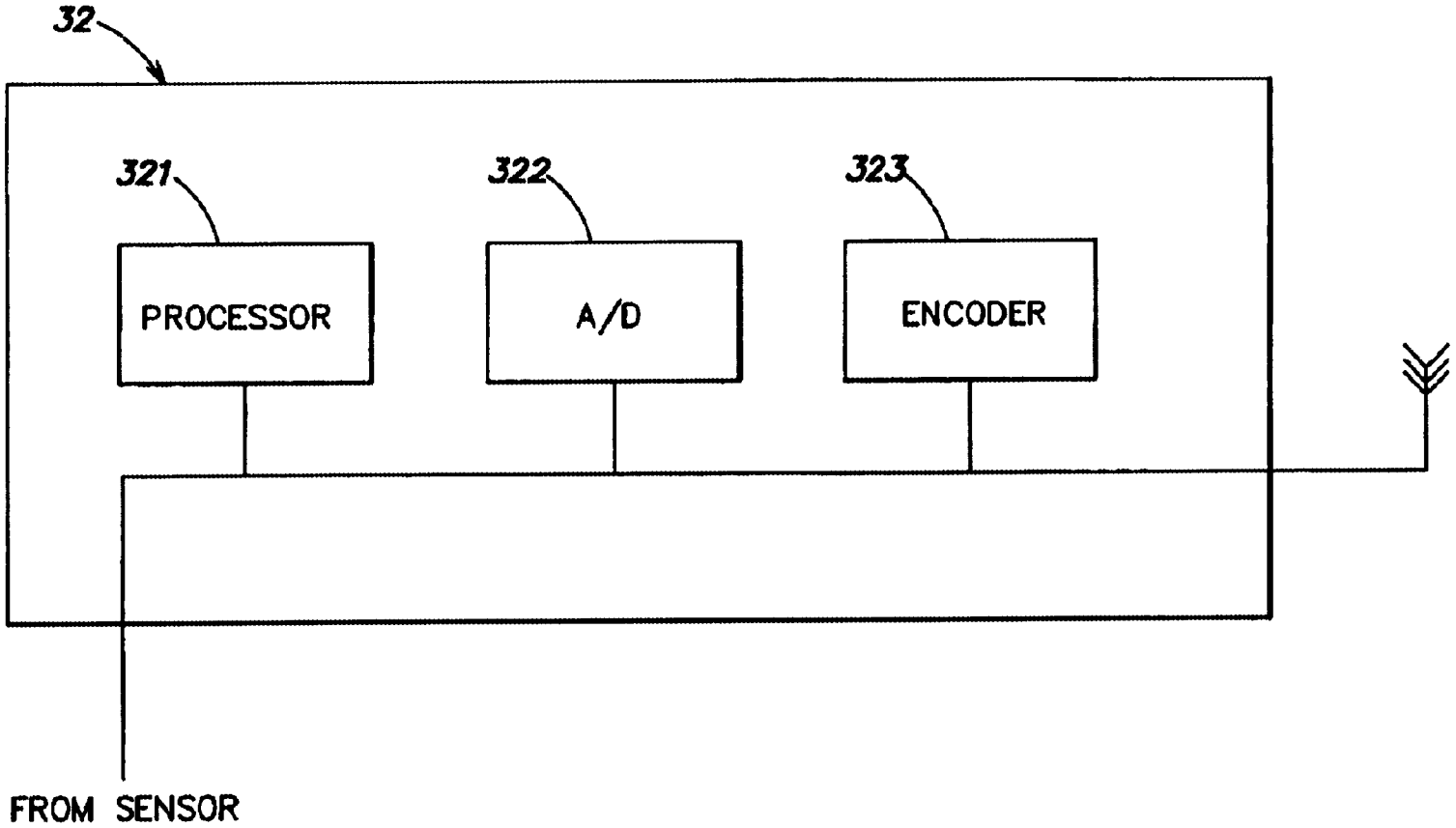
FIG. 3 is a schematic block diagram of a transmitter in accordance with the invention.

FIG. 3 shows a schematic block diagram of a transmitter 32 in an illustrative embodiment. In this illustrative embodiment, the transmitter 32 includes a processor 321, an analog-to-digital (A/D) converter 322 and an encoder 323. It should be understood, of course, that the transmitter 32 is not limited to those components shown in FIG. 3, but instead may include any suitable components. In this illustrative embodiment, a signal from the sensor, for example, an analog voltage level, may be received by the transmitter 32 and converted to a digital format by the A/D converter 322 under the control of the processor 321. The resulting digital signal and other information may be processed by an encoder 323 to put it in suitable form for wireless transmission. The encoder 323 may include any suitable components for placing the information in suitable form for wireless transmission, as is well understood in the art.

Figure 4:
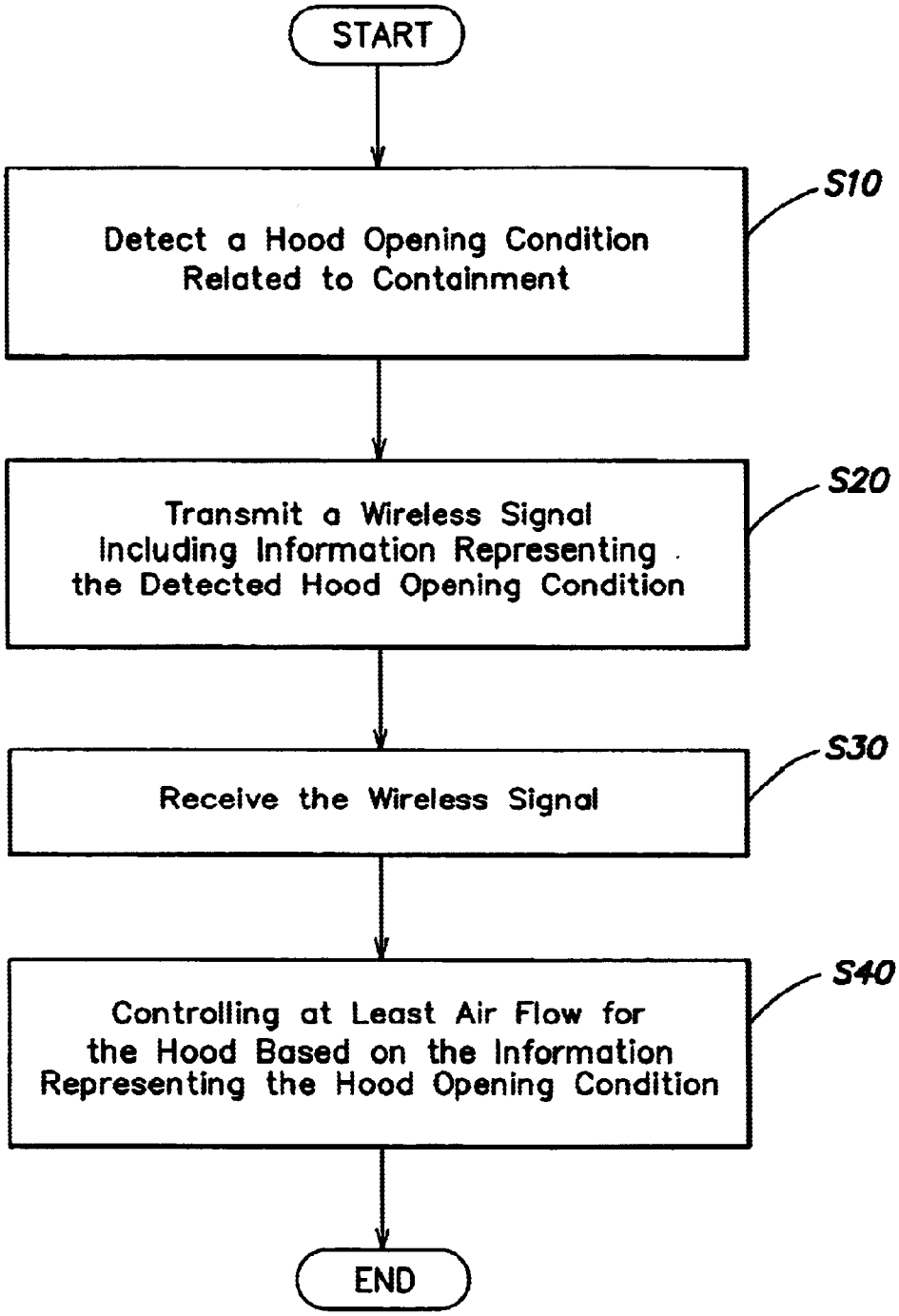
FIG. 4 shows steps of a method for controlling a fume hood in accordance with an aspect of the invention.

FIG. 4 shows a flow chart of steps of a method in accordance with the invention. In this illustrative embodiment, in step S10 a containment condition related to containment at the hood opening is detected. This containment condition may be a change in size of the area of the hood opening, a movement or position of a sash, the presence of a person at the hood opening, movement of air or other objects at or near the hood opening, or any other suitable condition that is related to containment of the hood, i.e., a condition that may affect containment of potentially harmful substances within the hood. The containment condition may be detected in any suitable way using any suitable sensor. For example, sash position may be detected using mechanical position switches, photo detectors, magnetically-actuated reed switch, radio frequency tags, or other similar devices, etc. Other containment conditions, such as air movement or the presence of a person, may be detected using these or other suitable sensors. For example, a person wearing an RF ID tag may be detected by a suitable sensor at or near the hood opening.

In step S20, a wireless signal including information representing the detected containment condition is transmitted. This wireless signal may be sent in any suitable way using any suitable protocol, format, or other feature. For example, the wireless signal may be a radio frequency signal in the 433 MHz range or other suitable radio band.

In step S30, the wireless signal is received, e.g., at a fume hood controller.

In step S40, at least airflow for the hood is controlled based on the information in the received wireless signal representing the containment condition. For example, a fume hood controller may determine an open area for the hood opening based on information regarding the sash position and control airflow through the hood to maintain a desired face velocity at the opening. Control may be performed by sending a wireless signal to appropriate components of the system, such as a damper that controls airflow through the hood.

This invention is not limited in its application to the details of construction and the arrangement of components set forth in the description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A fume hood apparatus comprising:

at least one sensor that detects a containment condition related to containment of substances in a fume hood housing having a hood opening;

at least one transmitter that transmits a wireless signal including information representing the containment condition detected by the at least one sensor; and a fume hood controller that receives the wireless signal and controls at least airflow through the hood opening based on the information representing the detected containment condition.

2. The apparatus of claim 1, further comprising:

at least one sash movable to adjust a size of the hood opening, and wherein the at least one transmitter is located on the at least one sash.

3. The apparatus of claim 1, wherein the at least one sensor includes first and second sensors, the first sensor detecting a position of a sash that is movable to adjust a size of the hood opening, and the second sensor detecting the presence of a person at or near the hood opening.

4. The apparatus of claim 1, wherein the at least one sensor includes an array of magnetically-actuated reed switches that move between open and closed positions based on movement of a sash to adjust a size of the hood opening.

5. The apparatus of claim 1, wherein the at least one sensor includes a reel-type cable sensor that outputs a signal related to a sash that is movable to adjust a size of the hood opening.

6. The apparatus of claim 1, wherein the fume hood controller includes a receiver located in the hood housing that receives the wireless signal from the at least one transmitter.

7. The apparatus of claim 1, wherein the information representing a detected containment condition includes information representing a size of the hood opening.

8. The apparatus of claim 1, comprising:

two sashes movable relative to each other to adjust the fume hood opening, and wherein the at least one sensor detects a position of one sash relative to the other sash.

9. The apparatus of claim 1, wherein the fume hood controller is adapted to take action to maintain containment in the fume hood when a wireless signal is not properly received from the at least one transmitter.

10. The apparatus of claim 1, wherein the fume hood controller outputs a wireless signal to an airflow control device to control airflow through the hood opening.

11. The apparatus of claim 1, wherein the fume hood controller is adapted to receive wireless signals regarding detected containment condition information for a plurality of fume hoods and is adapted to control at least airflow in the plurality of fume hoods based on the detected containment condition information.

12. A fume hood apparatus comprising:

at least one sash movable to adjust a fume hood opening;

at least one sensor that detects a position of the at least one sash;

a transmitter that transmits a wireless signal including information representing a detected position of the sash; and a fume hood controller that receives the wireless signal and controls at least airflow through the fume hood opening based on the information representing the detected position of the sash.

13. The apparatus of claim 12, further comprising:

a sensor that detects the presence of a person at or near the hood opening and provides information to the fume hood controller via wireless signal.

14. The apparatus of claim 12, wherein the transmitter includes a radio transmitter that outputs a wireless radio signal.

15. The apparatus of claim 12, wherein the at least one sensor includes an array of magnetically-actuated reed switches that move between open and closed positions based on movement of a sash to adjust a size of the hood opening.

16. The apparatus of claim 12, wherein the at least one sensor includes a reel-type cable sensor that outputs a signal related to a sash that is movable to adjust a size of the hood opening.

17. The apparatus of claim 12, wherein the fume hood controller includes a receiver located in a hood housing that receives the wireless signal from the transmitter.

18. The apparatus of claim 12, comprising:

two sashes movable relative to each other to adjust the fume hood opening, and wherein the at least one sensor detects a position of one sash relative to the other sash.

19. The apparatus of claim 12, wherein the at least one sensor detects a position of the at least one sash relative to a hood housing.

20. The apparatus of claim 12, wherein the fume hood controller is adapted to take action to maintain containment in the fume hood when a wireless signal is not properly received from the transmitter.

21. The apparatus of claim 12, wherein the fume hood controller is adapted to output a wireless signal to an airflow control device to control airflow through the hood opening.

22. The apparatus of claim 12, wherein the fume hood controller is adapted to receive wireless signals regarding detected containment condition information for a plurality of fume hoods and is adapted to control at least airflow in the plurality of fume hoods based on the detected containment condition information.

23. A method for controlling a fume hood apparatus, comprising:

providing a fume hood housing having a hood opening;

detecting a containment condition related to containment of potentially harmful substances in the hood;

transmitting a wireless signal including information representing the detected containment condition; and controlling at least airflow through the hood opening based on the wireless signal.

24. The method of claim 23, wherein the step of detecting a containment condition comprises:

detecting a position of at least one sash movable to adjust a size of the hood opening.

25. The method of claim 23, wherein the step of transmitting comprises:

transmitting a wireless radio signal.

26. The method of claim 23, wherein the step of detecting a containment condition comprises:

detecting the position of an array of magnetically-actuated reed switches that move between open and closed positions based on movement of a sash to adjust a size of the hood opening.

27. The method of claim 23, wherein the step of detecting a containment condition comprises:

detecting a resistance of a potentiometer in a reel-type cable sensor that outputs a signal related to a sash that is movable to adjust a size of the hood opening.

28. The method of claim 23, further comprising:

receiving the wireless signal at a receiver located in the hood housing.

29. The method of claim 23, wherein the step of transmitting a wireless signal comprises:

transmitting a wireless signal including information representing a size of the hood opening.

30. The method of claim 23, wherein the step of detecting a containment condition comprises:

detecting the position of two sashes movable relative to each other to adjust a size of the hood opening.

31. The method of claim 23, wherein the step of detecting a containment condition comprises:

detecting a position of at least one sash relative to the hood housing.

32. The method of claim 23, wherein the step of transmitting a wireless signal comprises:

transmitting a wireless signal from a transmitter located on a sash movable to adjust a size of the hood opening.

33. The method of claim 23, wherein the step of detecting a containment condition comprises:

detecting at least one of a presence of a person at or near the hood opening, air movement at or near the hood opening, and movement of at least one object in the hood housing.

34. The method of claim 23, further comprising:

maintaining containment when a wireless signal is not properly received from the transmitter by one of increasing an airflow in the hood, providing an indication to actuate an alarm, and automatically reducing a size of the hood opening.

35. The method of claim 23, wherein the step of controlling at least airflow through the hood opening comprising:

transmitting a wireless signal to an airflow control device to adjust airflow in the hood opening.

36. A fume hood apparatus, comprising:

at least one sensor that detects a containment condition related to containment of substances in a fume hood housing having a hood opening;

an airflow control device that controls airflow through the hood opening; and a fume hood controller that receives information from the sensor regarding the detected containment condition and sends a wireless signal to the airflow control device to control at least airflow through the hood opening based on the information representing the detected containment condition.

37. The apparatus of claim 36, wherein the airflow control device includes a damper that has a movable element to adjust airflow through the hood opening.

* * * * *